US006314769B1

(12) United States Patent
Brandenburg

(10) Patent No.: US 6,314,769 B1
(45) Date of Patent: Nov. 13, 2001

(54) MULTIPLE DESIGN FABRIC

(76) Inventor: Jacqueline A. Brandenburg, 2772 S. Lincoln St., Englewood, CO (US) 80110

( * ) Notice: Subject to any disclaimer, the term of this patent is extended or adjusted under 35 U.S.C. 154(b) by 0 days.

(21) Appl. No.: 08/941,501

(22) Filed: Sep. 30, 1997

(51) Int. Cl.[7] ..... D04B 13/00
(52) U.S. Cl. ..... 66/198
(58) Field of Search ..... 66/1 R, 85 R, 66/170, 190, 191, 197, 169 R, 193, 196, 198; 112/116

(56) References Cited

U.S. PATENT DOCUMENTS 402,468 * 4/1889 Merrow ..... 66/193
414,233 * 11/1889 Merrow ..... 66/193
1,811,813 * 6/1931 Wagner ..... 66/193
2,655,017 * 10/1953 Scott ..... 66/193
2,796,654 * 6/1957 Ashcroft ..... 66/195
2,959,947 * 11/1960 MacCaffray, Jr. ..... 66/192
3,886,768 * 6/1975 Anderson ..... 66/195
3,893,310 * 7/1975 Palfy ..... 66/169 R

* cited by examiner

*Primary Examiner*—John J. Calvert
*Assistant Examiner*—Robert Muromoto, Jr.
(74) *Attorney, Agent, or Firm*—Joseph C. Herring

(57) ABSTRACT

The crocheted fabrics of this invention have rows of scallops (shells under tension) alternating on each side of the fabric with each scallop overlaying a void which is traversed by a strand of the yarn. Preferably, the fabric is created, in a chrocheting process, by omitting chaining between scallops, beginning each new row at the point of the last stitch in the next previous row and eliminating the stitch attaching each scallop to the peak of the adjacent scallop in the just formed row.

16 Claims, 5 Drawing Sheets

MULTIPLE DESIGN FABRIC

BACKGROUND OF THE INVENTION

Crocheting, knitting and other forms of creating new fabrics and new fabric designs have been known for decades and many fabrics and design elements have been used for centuries.

Typical designs which include voids are found in U.S. Des. Pat. No. 80,973 issued to H Schwarber, U.S. Des. Pat. No. 86,747 issued to A. Ruesch, U.S. Des. Pat. No. 135,328 issued to L. Herszkowicz, and U.S. Des. Pat. No. 206,649 issued to J. J. R. Vinegla et al. Typical designs which include two-dimensional, non-tensioned "shells" are also known. For example, U.S. Des. Pat. No. 402,468 and U.S. Des. Pat. No. 414,233, issued to J. S. Merrow, and U.S. Des. Pat. No. 2,655,017 issued to B. L. Scott.

New fabrics, fabric designs, fabric textures, etc. are desired by those creating clothing, furniture coverings, etc. and this invention provides new fabrics with many design possibilities.

SUMMERY OF THE INVENTION

The new fabrics and new designs of this invention have rows of scallops; i.e., tensioned, three-dimensional shells alternating on opposite sides of a single layer fabric with each scallop overlaying a void which is traversed by a strand of the yarn.

DETAILED DESCRIPTION OF THE DRAWINGS

Figure 1:
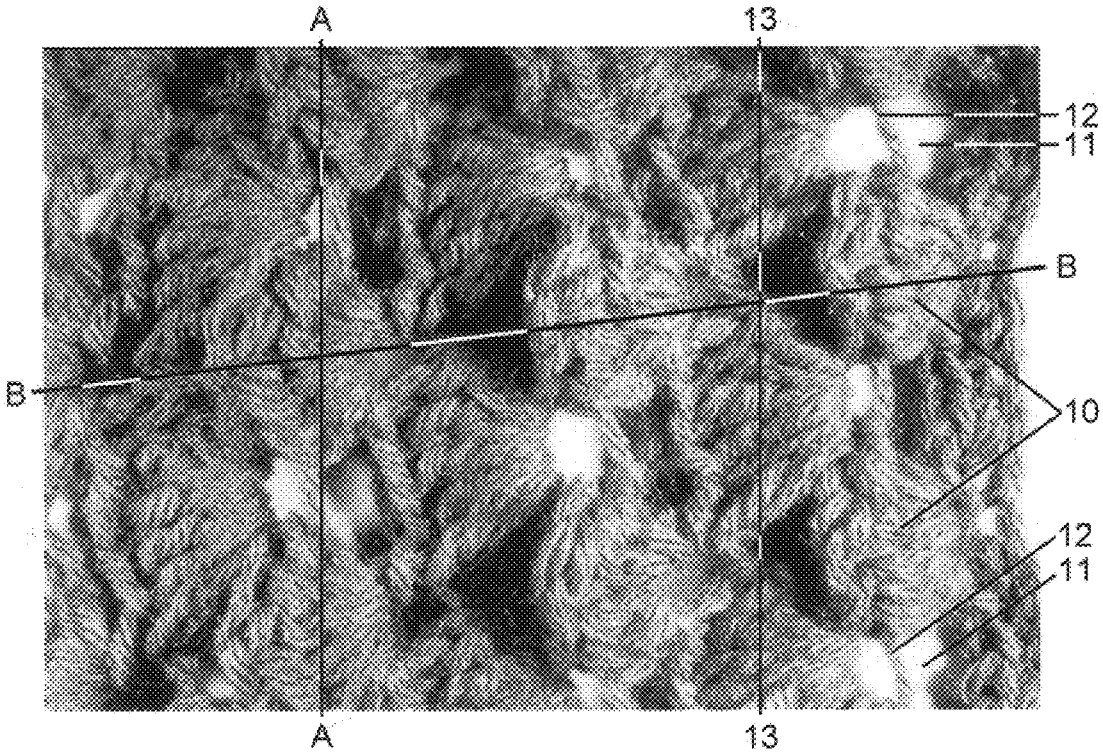
FIG. 1 is a photograph of one side of a fabric having scallops of approximately uniform size.

FIG. 1 shows a preferred fabric made from a dark yarn and photographed against a light background. A number of scallops 10 on the bottom side of the fabric have been displaced from their normal position overlying voids 11 to show a strand 12 of yarn which traverses the void beneath the scallops 10 at various levels. Other scallops 13 on the bottom side under the strands 12 are left in place. Rows A—A and columns B—B of scallops 10 are plainly visible.

Figure 2:
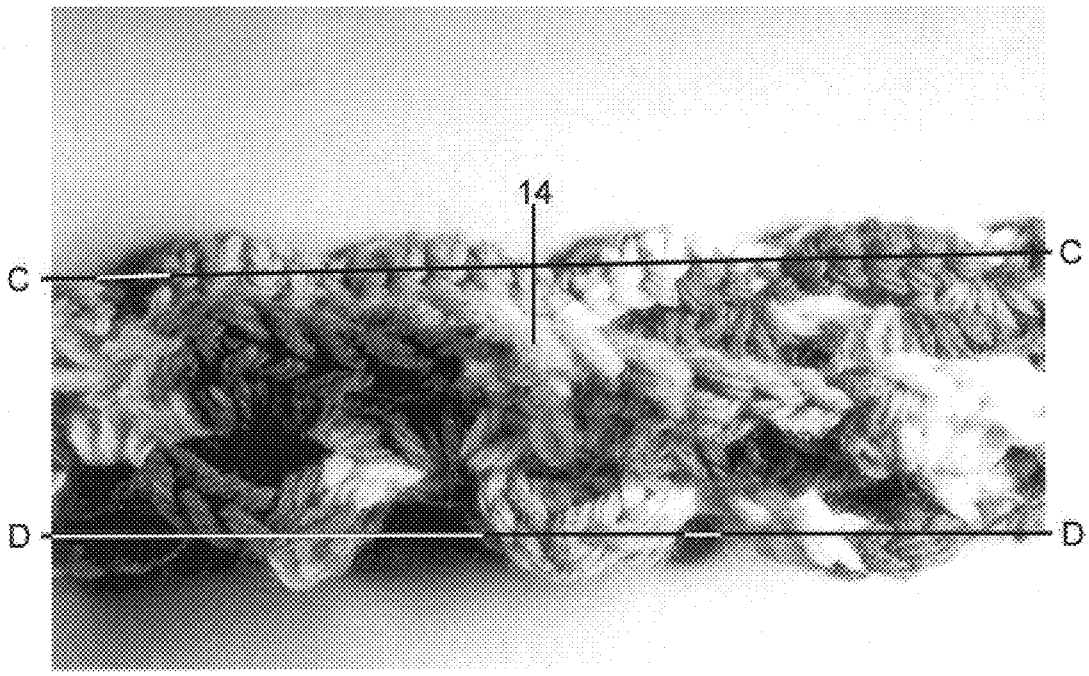
FIG. 2 is a photograph of the edge of a fabric of this invention.

FIG. 2 is a picture of a fabric made up of an acrylic yarn of varying colors. It shows a top row C—C of scallops and a bottom row D—D of scallops, as seen adjacent the fabric edge 14. This figure indicates the luxuriant thickness of the fabric when formed from a four ply knitting and/or crocheting yarn.

Figure 3:
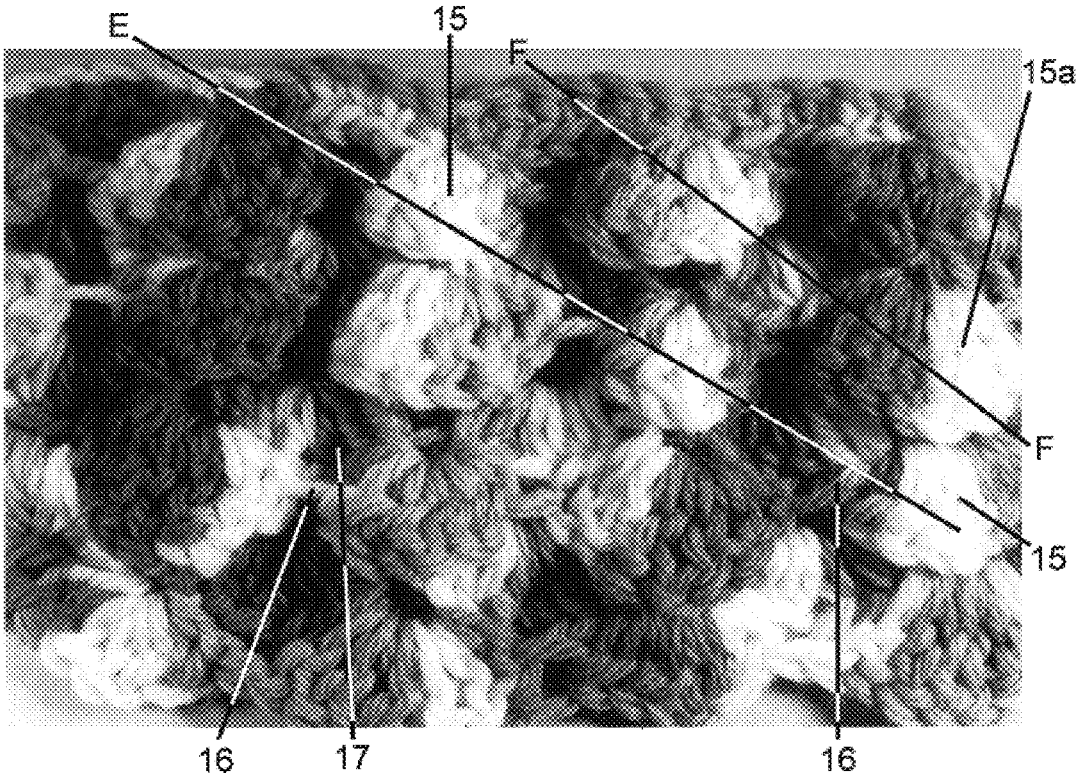
FIG. 3 is a photograph of the fabric of FIG. 2 having both small and large scallops on one side.

FIG. 3 shows another portion of the fabric made from the yarn of FIG. 2 from a side view. The diagonal row E—E of small scallops is adjacent row F—F of larger scallops 15*a*. Strands 16 of yarn are shown crossing voids 17 over the lower layer of scallops. The strands 16 tend to keep the scallops on each side of the fabric from being pushed through to the other side.

Figure 4:
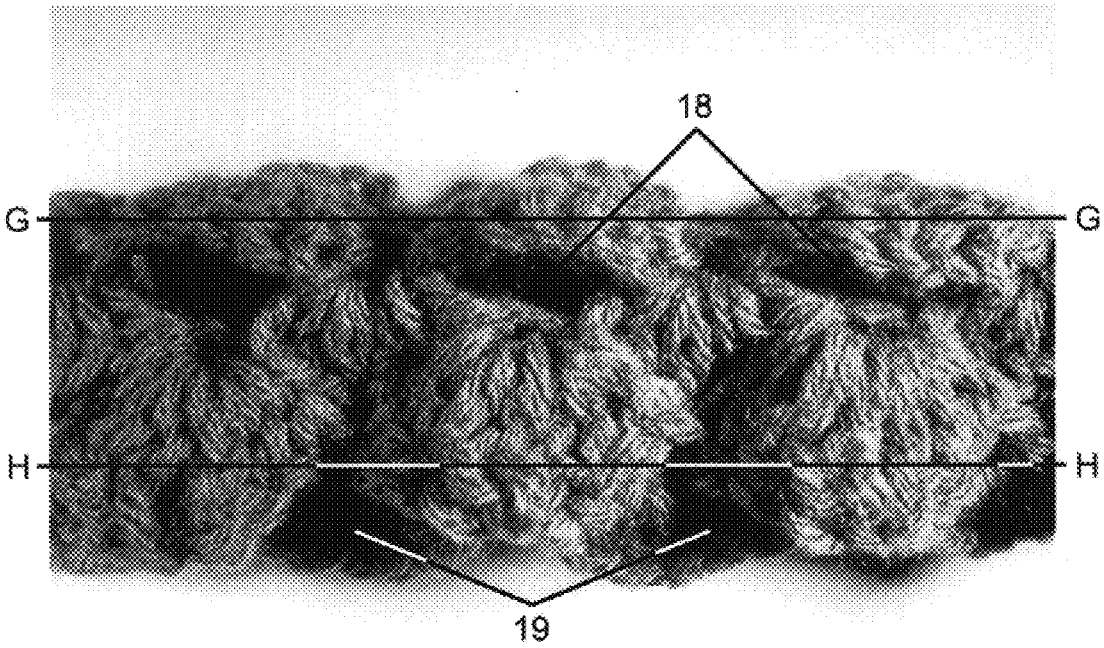
FIG. 4 is a photograph of the fabric of FIG. 1 doubled over to show scallops and voids.

FIG. 4 shows the fabric of FIG. 1 bent into a "U" shape to show an upper row G—G of scallops, a lower row H—H, and a still lower row of scallops 19 running across the fabric. The voids 18 underlying the scallops are very visible due to the bends in the fabric.

Figure 5:
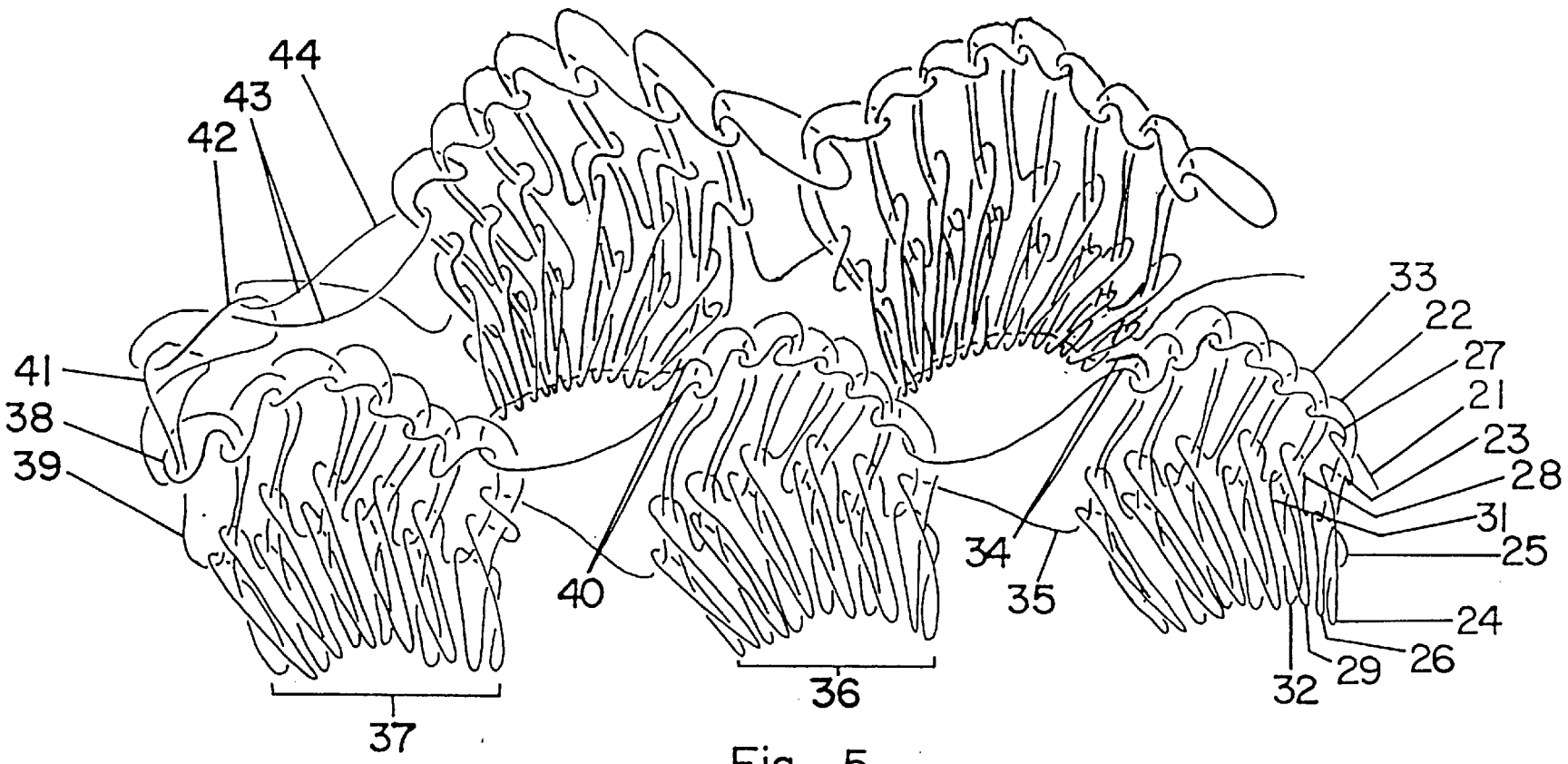
FIG. 5 delineates the course of a strand of yarn through a loosely corcheted fabric.

FIG. 5 apparently shows the course of the yarn through two very loosely crocheted rows showing the near side of the fabric on the bottom row and the reverse side on the second row. In reality, the scallops would form into one row. The crocheting steps for forming the fabric are taught under "Fabric Manufacture" below. The lower row of scallops is made up of half double crochets with six stitches each. The upper right scallop is made up of six double crochets and is relatively long. The upper left scallop is made up of double crochets with eight stitches to make it longer and wider. The loops at the bottom of the bottom row would be attached to the chain stitching forming an edge (not shown). The yarn begins at point 21, circles loop 22 at point 23 and descends in a loop which anchors to the base chain. When the loop reverses and rises, at point 24, the ascending portion of the loop 25 again loops and descends to point 26, where it rises again to form loop 22. The descending yarn 27 hooks under loop 25 before rising to form loop 28. The descending yarn from loop 28 forms a third loop 29 to anchor the forming scallop to the base chain. The yarn rises from loop 29 to form an upper loop 31 which descends to loop 32 and rises again to form loop 33 of yarn which passes through loop 22. At this point the pattern of crocheting is established and continues to loop 34, the descending leg 35 of which forms the strand of yarn which passes behind the scallop formed on the other side of the fabric by the next (upper) row of scallops.

The continuation of the crocheting forms a second scallop 36 and a third scallop 37. Instead of forming a fourth scallop, the descending branch of loop 38 loops at loop 39 and recurves to form loop 41, the descending leg of which again recurves to form loop 42 which passes through loop 41 and continues as the two sides of loop 44 to form the beginning of the second row which is the "other side of the fabric. Scallop 36 has a loop 40 into which the stitches of scallop 45 are crocheted. No chain stitches interconnect the bases of the individual scallops 36 and 37 or the base of scallop 45 with the loop 40 of scallop 36.

The loops 34 and 40 are loosely displaced in space for purposes of illustration and, when tightened, form a fabric with alternating rows of scallops, on opposite sides of the fabric with no attachment between the tops of the scallops in one row and the next row of scallops.

FIGS. 6–10 have arrows denoting the direction of the crocheting which forms the scallops.

Figure 6:
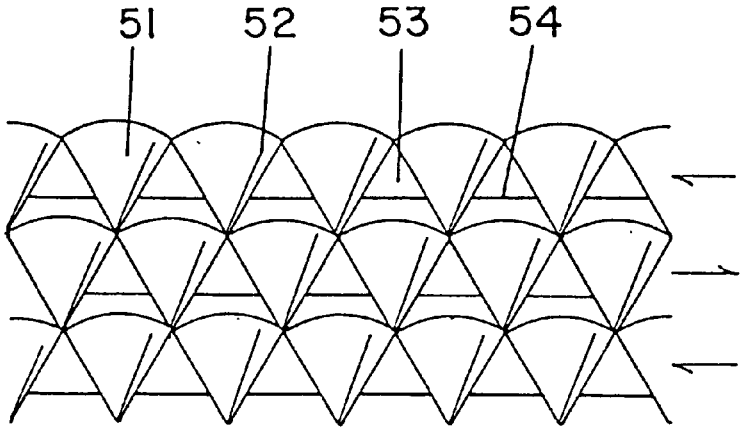
FIGS. 6–10 graphically depict fabrics manufacturable using the new crocheting process.

FIG. 6 is a diagrammatic exposition of a fabric having scallops 51 (shown with an indentifying angular bar 52) on the near side and scallops 53 facing away (with a horzontal bar 54 depicting the yarn strand which holds each row of scallops in its place. All scallops are of uniform size.

Figure 7:
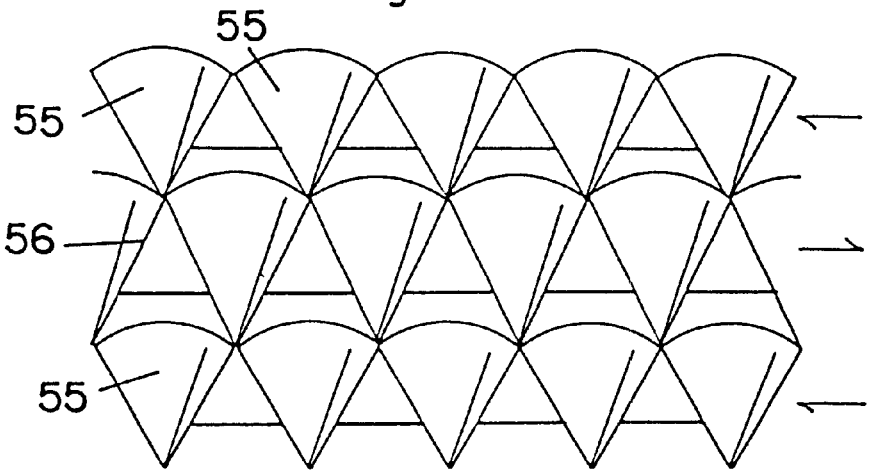

FIG. 7 utilizes the same representation as that of FIG. 6 to depict a portion of a fabric having alternating short scallops 55 and long scallops 56.

Figure 8:
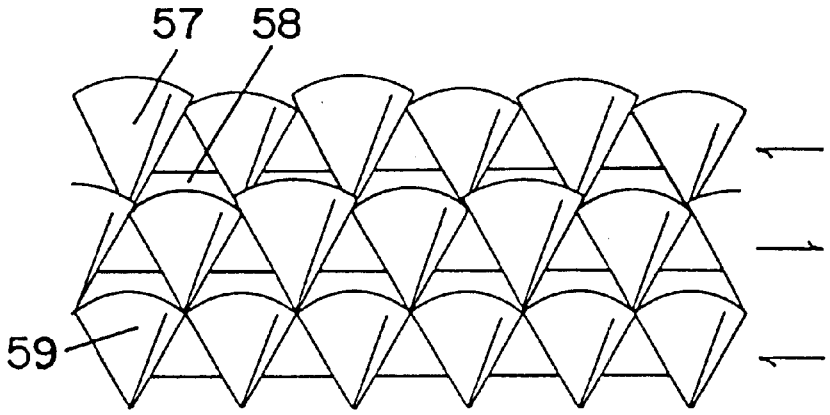

FIG. 8 depicts a portion of a fabric with long scallops 57 and short scallops 58 alternating in each row with each row offset so as to create a geometric design on each side of the fabric with scallops of equal sizes forming diagonal columns. The bottom row, however, has all scallops 59 of the same size.

Figure 9:
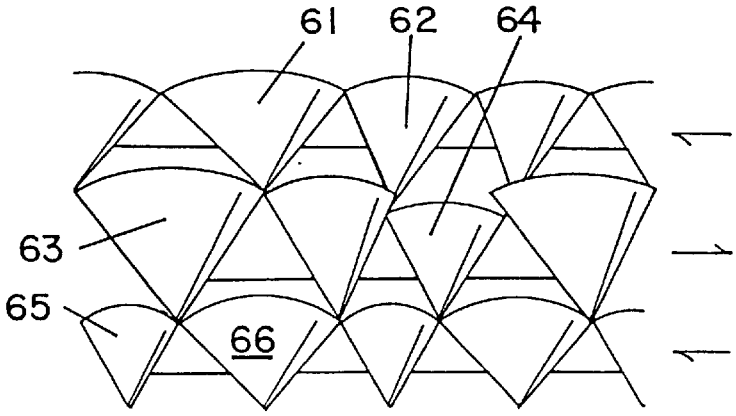

FIG. 9 depicts a fabric with both geometric (bottom row) and nongeometric (top two rows) designs. In the top two rows, the scallops vary in height and width with, for example, a wide scallop 61 and a more narrow scallop 62 in the top row and a tall and wide scallop 63 and a short and more narrow scallop 64 in the middle row. The bottom row has alternating narrow scallops 65 and wide scallops 66.

Figure 10:
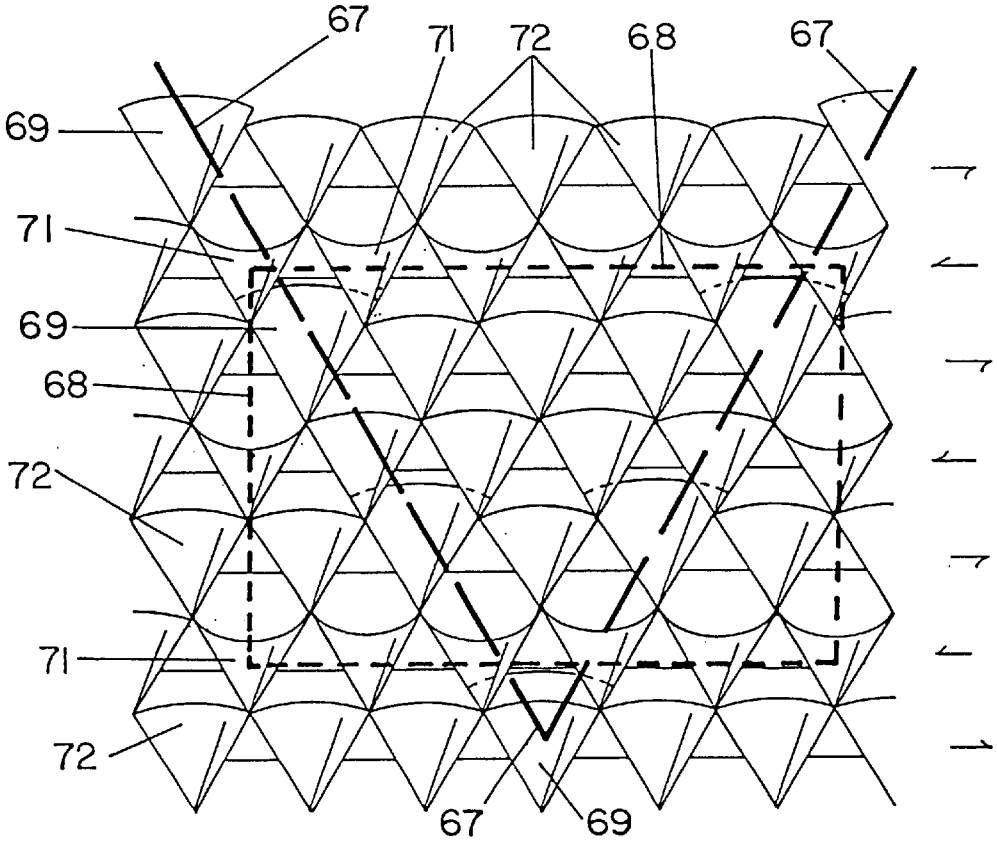

FIG. 10 depicts a fabric with a V pattern 67 on the reverse side and a square pattern 68 on the near side. The V pattern 67 is made up of longer scallops 69 and the square pattern 68 is made up of shorter scallops 71 than the uniformly sized background scallops 72.

GENERAL DESCRIPTION OF THE INVENTION

The fabric, as can be seen from the Figures, is bulky and requires 30–40% more yarn than fabrics having shells on only one side. Yarns commonly used in making knitted and crocheted fabrics for clothes such as sweaters are useful for making up the fabrics of this invention. The fabrics can be made in squares, rectangles, etc. and used, with like or unlike fabrics, to create a variety of fabric designs, clothes, and furniture coverings.

The scalloped fabrics of this invention can have all scallops of uniform size or the scallop sizes can vary either uniformly or nonuniformly. Thus, large and small scallops can be put into a fabric with a background of uniformly sized scallops to create either regular or irregular designs. Columns and rows of scallops of differing sizes and colors can form designs having vertical, horizontal, and diagonal elements. The scallop sizes can vary gradually or abruptly from small to large. One side can have scallops of a uniform size while the other side can have scallops of the same size or of one or more different sizes to form irregular or geometric designs.

Scallops of different sizes are formed by varying the number of stitches to make a wider scallop, by varying yarn diameter, and by varying the stitch used. For example, scallops can be made with double crochets, while deeper (taller or larger) scallops can be made with a treble crochet. An increase in overall crocheting tension can be used to increase the buckling of the scallops and the thickness of the fabric. Yarns can also be varied to provide other desired qualities, e.g., texture, reflectivity, softness, and warmth.

The "shells" of the prior art and the "scallops" of the fabrics of this invention differ because shells tend to be flat while the scallops are three dimensional, i.e., are buckled outwardly. The difference, assuming an equal tension on the strand of yarn being crocheted, results from several differences in the crocheting process. In the formation of shells, a space is normally created between the shells by chaining and subsequent rows of the shells are begun in the chained space of the previous row. In the process of making the fabrics of this invention, there is no chaining and the stitch at the peak of the scallop in the previous row is omitted. Subsequent rows are started at the point of the last stitch of each scallop in the previous row. This causes each row of the scallops to be offset by the width of a scallop.

The elimination of the chained spacing and the stitch causes the alternating rows of scallops to protrude on opposite sides of the fabric thereby creates a "void" or "open" space at the centerline of the fabric. The void is "traversed" by the strand of yarn between adjacent scallops. The buckling of the "shells" into "scallops" which results due to the elimination of the chaining creates an "apparent" bridging strand because the adjacent scallops are forced apart by the buckling of the adjacent row(s), i.e., the scallops would prefer to lie flat as shells but tension on the yarn forces buckling.

The scalloped fabrics of this invention can be made by hand or machine. The manufacture of illustrative fabrics with scallops of various sizes and patterns is described below. The following abbreviations are utilized here:

beg . . . begin(ning)

ch . . . chain hdc . . . half-double crochet trc . . . treble crochet

* . . . repeat from * as indicated.

FIG. 2 shows a Double Delight fabric of this invention with an edge and all scallops of the same size. This fabric can be crocheted as follows:

FABRIC MANUFACTURE

Begin row 1: Ch in increments, evenly divisible by 6; ch 2 to turn;

Begin row 2: * hdc in second stitch from hook and repeat from * across to end; ch 2 to turn.

Begin row 3: In the third (½ of 6) stitch from the end, crochet * 3 hdc, ch 1, 3 hdc (scallop). Repeat from * across in every sixth stitch to end of row, where there will be only 3 stitches remaining; crochet hdc in last stitch; ch 2 to turn.

Begin row 4: Crochet scallop in space between each previous scallop across, then 3 hdc in ch 2 space at end; ch 2 to turn.

Pattern: Repeat row 4 to desired length of fabric.

A fabric with alternating diagonal rows of long and short scallops like those in FIG. 3 can be made as follows:

Begin row 1: Ch in increments, evenly divisible by 6; ch 2 to turn;

Begin row 2: * hdc in second stitch from hook and repeat from * across to end; ch 2 to turn;

Begin row 3: In third stitch from end, crochet * 3 hdc, ch 1, 3 hdc (short scallop). In the 6th stitch, crochet 3 trc, ch 1, 3 trc (long scallop). Repeat from * across alternating scallop sizes across to the last three stitches remaining; crochet hdc in last stitch; ch 2 to turn.

Begin row 4: Repeat row 3 except * begin with scallop of 3 trc, ch 1, 3 trc, then alternate with scallop of 3 hdc, ch 1, 3 hdc, across; then 3 hec in ch 2 space.

Pattern: Alternate rows 3 and 4 to desired overall fabric length.

A fabric for reversible sweaters, etc. having short scallops on one side of the fabric and long scallops on the other side can be made as follows:

Begin row 1: Ch in increments, evenly divisible by 6; ch 2 to turn;

Begin row 2: * hdc in second stitch from hook and repeat from * across to end; ch 2 to turn.

Begin row 3: In third stitch from end, crochet *3 hdc, ch 1, 3 hdc (short scallop). Repeat from * across in every 6th stitch to the last three stitches remaining; crochet hdc in last stitch; ch 2 to turn.

Begin row 4: Crochet scallop of * 3 trc, ch 1, 3 trc (long scallop) in space between previous scallop across. Repeat from * across; then 3 hdc in chain 2 spaces at end.

Begin row 5: Repeat row 3.

Pattern: Alternating rows 3 and 4, repeat to overall desired length of fabric.

A fabric having wide scallops on one side of the fabric and narrow scallops on the other side can be made as follows:

Begin row 1: Ch in increments, evenly divisible by 6; ch 2 to turn;

Begin row 2: * hdc in second stitch from hook and repeat from * across to end; ch 2 to turn.

Begin row 3: In the 3rd stitch from end, crochet a wide scallop of * 4 hdc, ch 1, 4 hdc, repeat from * across in every 6th stitch to end of row; crochet hdc in last stitch; ch 2 to turn.

Begin row 4: In space between previous scallops across, crochet narrow scallops of * 3 hdc, ch 1, 3 hdc. Repeat from * across to end of row; then 3 hdc in chain 2 spaces; ch 2 to turn.

Begin row 5: Repeat row 3.

Pattern: Alternating row 3 and 4, repeat to desired overall length of fabric.

Elements of the above delineated procedures can be used to create geometric and nongeometric designs with both regular and irregular, e.g., random, design changes.

What is claimed is:

1. In crotcheted fabric comprising, at least in part, rows of flat shells, formed from a single strand of yarn joined at their base under sufficient tension to convert the substantially flat shells into three dimensional scallops with the scallops alternately projecting outwardly on opposite sides of the fabric to substantially overlay voids in the fabric, each of which voids are bridged by essentially.

2. A crocheted fabric from an essentially comprising, at least in part, rows of flat shells, formed from a single strand of yarn joined under sufficient tension to convert the shells into three dimensional scallops and connected to adjacent rows of scallops at their base only, and with the scallops alternately projecting outwardly on opposite sides of the fabric to form and overlay adjacent voids in the fabric, each void being bridged by a portion of the strand of yarn.

3. The fabric of claim 1 wherein the scallops are of uniform size.

4. The fabric of claim 1 wherein the scallops are of nonuniform size.

5. The fabric of claim 1 wherein alternate rows of scallops are of different sizes.

6. The fabric of claim 1 wherein at least a portion of the scallops on each side of the fabric are of different sizes and the size of the remaining scallops on each side is uniform.

7. The fabric of claim 1 wherein the sizes of at least a portion of the scallops differ from that of the other scallops to form at least one of geometric and nongeometric patterns over at least a portion of the fabric.

8. The fabric of claim 7 wherein the fabric has patterns and the patterns on each side of the fabric differ.

9. The fabric of claim 7 wherein at least a portion of the fabric has an irregular scallop pattern.

10. The fabric of claim 1 wherein the scallops are of uniform size.

11. The fabric of claim 1 wherein the scallops are of nonuniform size.

12. The fabric of claim 1 wherein alternate rows of scallops are of different sizes.

13. The fabric of claim 1 wherein at least a portion of the scallops on each side of the fabric are of different sizes and the remaining scallops on each side are uniform.

14. The fabric of claim 1 wherein the sizes of at least a portion of the scallops differ from that of the other scallops to form at least one of geometric and nongeometric patterns over at least a portion of the fabric.

15. The fabric of claim 1 wherein the fabric has patterns and the patterns on each side of the fabric differ.

16. The fabric of claim 1 wherein the fabric has ratterns and at least a portion of the fabric has non-uniform amounts of chaining between scallops in a random pattern.

* * * * *